US008925833B2

(12) United States Patent
Ki et al.

(10) Patent No.: US 8,925,833 B2
(45) Date of Patent: Jan. 6, 2015

(54) PORTABLE ELECTRIC MIST SUPPLY APPARATUS FOR LIQUID COSMETICS

(75) Inventors: Joong-Hyun Ki, Incheon (KR); Su-Jin Son, Incheon (KR); Sung-Sin Kim, Incheon (KR)

(73) Assignee: Yonwoo Co., Ltd, Incheon (KR)

( * ) Notice: Subject to any disclaimer, the term of this patent is extended or adjusted under 35 U.S.C. 154(b) by 0 days.

(21) Appl. No.: 13/255,492

(22) PCT Filed: Jul. 26, 2011

(86) PCT No.: PCT/KR2011/005508

§ 371 (c)(1),
(2), (4) Date: Sep. 8, 2011

(87) PCT Pub. No.: WO2012/015225

PCT Pub. Date: Feb. 2, 2012

(65) Prior Publication Data

US 2013/0112771 A1 May 9, 2013

(30) Foreign Application Priority Data

Jul. 26, 2010 (KR) ..... 10-2010-0071860
Jul. 26, 2011 (KR) ..... 10-2011-0073990

(51) Int. Cl.

| | |
|---|---|
| ***B05B 17/06*** | (2006.01) |
| ***A45D 34/02*** | (2006.01) |
| ***B05B 17/00*** | (2006.01) |
| ***B05B 11/00*** | (2006.01) |
| ***A45D 34/04*** | (2006.01) |
| *A45D 34/00* | (2006.01) |

(52) U.S. Cl.

CPC ..... *B05B 17/0607* (2013.01); *A45D 34/02* (2013.01); *B05B 17/0646* (2013.01); *B05B 11/3001* (2013.01); *A45D 2200/207* (2013.01); *A45D 2034/007* (2013.01); *A45D 34/04* (2013.01); *A45D 2200/056* (2013.01); *A45D 2200/057* (2013.01)

USPC ..... 239/102.2; 239/102.1; 239/329

(58) Field of Classification Search

CPC B05B 11/3001; B05B 17/06; B05B 17/0607; B05B 17/0638; B05B 17/0646; B05B 17/0653; B05B 17/0676; A45D 2200/056; A45D 2200/057; A45D 2200/207

USPC ..... 239/4, 102.1, 102.2, 124, 127, 329

See application file for complete search history.

(56) References Cited

U.S. PATENT DOCUMENTS

| | | | | |
|---|---|---|---|---|
| 2005/0207917 | A1 * | 9/2005 | Koerner et al. | 417/413.2 |
| 2009/0236437 | A1 * | 9/2009 | Schuerle et al. | 239/4 |
| 2011/0303761 | A1 * | 12/2011 | Kohnle et al. | 239/102.1 |

FOREIGN PATENT DOCUMENTS

| | | | | |
|---|---|---|---|---|
| KR | 1020100057339 | A | 5/2010 | |
| WO | WO 2005097350 | A1 * | 10/2005 | B05B 17/06 |

* cited by examiner

*Primary Examiner* — Darren W Gorman

(57) ABSTRACT

A portable electric mist supply apparatus for liquid cosmetics is disclosed. Liquid cosmetics such as cosmetic water or the like are stored in a storing container which is detachably engaged, and the stored liquid cosmetics is discharged by a certain amount when in use, in a form of mist particles with the aid of a ultrasonic vibrator.

17 Claims, 18 Drawing Sheets

PORTABLE ELECTRIC MIST SUPPLY APPARATUS FOR LIQUID COSMETICS

TECHNICAL FIELD

The present invention relates to a portable electric mist supply apparatus for liquid cosmetics, and in particular to a portable electric mist supply apparatus for liquid cosmetics which comprises a pump 110 which is formed of a tube 11 disposed at its lower side for sucking liquid cosmetics and a discharge tube 112 disposed at its upper side and serves to discharge a certain amount of liquid cosmetics when the discharge tube 112 is pushed; a storing container 120 which is detachably engaged to the pump 110 and stores the liquid cosmetics; a bucket 130 which includes an exhaust port 131 which is engaged to the discharge tube 112 and is formed in its interior and is connected with the discharge tube 112, a discharge port 132 which is formed at a front lower side and discharges the liquid cosmetics, and a communication part 133 which is formed in the interior and communicates the exhaust part 131 and the discharge port 132; an ultrasonic vibrator means 140 which is engaged to the discharge port 132 and sprays the liquid cosmetics in a form of mist by using ultrasonic; a button 160 which is engaged to an upper side of the bucket 130; a front cover 170 and a rear cover 171 which are engaged with each other for thereby accommodating the pump 110, the bucket 130, the ultrasonic vibrator means 140 and the button 160; an ultrasonic driving means 210 which is accommodated in the interior of the front cover 170 and the rear cover 171 and drives the ultrasonic vibrator means 140 in accordance with a switch 201 which operates in accordance with an operation of the button 160; and an electric power part 220 which is accommodated in the front cover 170 and the rear cover 171 and supplies electric power to the ultrasonic driving means 210.

BACKGROUND ART

A mist supply apparatus generally represents an apparatus which is designed to spray liquid cosmetics in a mist state formed of micro particles, which liquid cosmetics contains certain aqueous solution selected depending on a user's use purpose like makeup water or miniaturization, whitening effect, nutrition supply function, etc.

The conventional mist supply apparatus is classified into a manual spray type mist supply apparatus which has been widely used, and a steam heating type mist supply apparatus.

The conventional manual spray type mist supply apparatus is designed to operate as a use manually pushes a corresponding button multiple times and is designed to spray liquid by using a discharge pressure from a small discharge hole, so the conventional apparatus is very hard to uniformly spray liquid in a form of micro size particles.

The conventional steam heating type mist supply apparatus is directed to spraying micro size particles which are made by heating liquid in a form of steam. The above apparatus makes it possible to spray liquid in a form of small and uniform micro particle; however a relatively larger electric power is needed in order to drive a heating apparatus, so the whole volume of an apparatus increases, which volume interferes with portability. Since the above apparatus adapts a liquid-heating way, the component of a liquid cosmetic might be changed.

In order to overcome the problems encountered in the above mist supply apparatus, as cited in the list of the prior art, the Korean patent publication number 10-2010-0057339 discloses a polymer or ceramic filter and portable moisture supplier adapting the same which comprises a storing container formed of a polymer or ceramic filter, a container for storing liquid and a discharge part to which the polymer or ceramic filter is detachably engaged; an outer casing which is formed of a storing container accommodation chamber in which the storing container is detachably accommodated at an upper inner side of the same, and a spray hole formed at the upper front side; a punch type ultrasonic vibrator disposed at a front side of an upper portion of the outer casing; and a spray tube which is disposed between the punch type ultrasonic vibrator and the spray hole in such a way that the liquid converted into mist by the punch type ultrasonic vibrator can communicate through the spray hole. The discharge part of the storing container is constituted with its one end being formed at a lower front side of the container, with the other end of which being protruded from the side of the punch type ultrasonic vibrator.

In case of the above mist supply apparatus, better spraying and mist generation effects can be obtained by the ultrasonic vibrator; however the liquid stored in the storing container seems to be forced to stay therein by means of the capillary phenomenon, so the stored liquid might leak into the interior of the storing container when an external movement or an external force is applied thereto like the mist supply apparatus is carried by a user in which a lot of movements exists. In this case, an additional construction preventing such leakage is necessarily needed.

In case of the conventional mist supply apparatus, since liquid cosmetics keeps contacting with the filter all the time, it is needed to use a special material such as a ceramic or the like, which is able to prevent bacteria proliferation or any contamination. In this case, even though a filter made from such special material and with an antibacterial function is used, the ultrasonic vibrator might be contaminated due to the leakage generating during the movement, which leads to the proliferation of bacteria or contamination, so that the above conventional mist supply apparatus has a lot of problem to be used as a mist supply apparatus which is designed to spray liquid cosmetics directly contacting with a human skin.

DISCLOSURE OF INVENTION

Accordingly, the present invention is basically directed to overcoming the above-described problems encountered in the conventional art. It is an object of the present invention to provide a portable electric mist supply apparatus for liquid cosmetics in which a storing container, which stores liquid cosmetics, is reliably sealed, and the liquid cosmetics are discharged by a certain amount when in use by using a pump, so any contamination of liquid or leakage do not occur in the present invention.

In the interior of the bucket is provided a communication part 133 the diameter of which is gradually decreased toward the lower side to be consistent with the inner diameter of the discharge port 132, so the liquid cosmetics does not remain in the interior of the bucket with the aid of the above construction and is completely sprayed, thus substantially preventing any contamination or malfunction when there remains any residues of liquid cosmetics.

It is another object of the present invention to provide a portable electric mist supply apparatus for liquid cosmetics which makes it possible to obtain a smooth and reliable operation by preventing the generation of foams or water membrane phenomenon occurring in the liquid cosmetic, with the aid of a distributor installed at a discharge port.

It is further another object of the present invention to provide a portable electric mist supply apparatus for liquid cosmetics which makes it possible to maximize the portability and convenience when in use since a carrying of apparatus and a change or charge of electric power are easy.

To achieve the above objects, there is provided a portable electric mist supply apparatus for liquid cosmetics, which comprises a pump 110 which is formed of a tube 11 disposed at its lower side for sucking liquid cosmetics and a discharge tube 112 disposed at its upper side and serves to discharge a certain amount of liquid cosmetics when the discharge tube 112 is pushed; a storing container 120 which is detachably engaged to the pump 110 and stores the liquid cosmetics; a bucket 130 which includes an exhaust port 131 which is engaged to the discharge tube 112 and is formed in its interior and is connected with the discharge tube 112, a discharge port 132 which is formed at a front lower side and discharges the liquid cosmetics, and a communication part 133 which is formed in the interior and communicates the exhaust part 131 and the discharge port 132; an ultrasonic vibrator means 140 which is engaged to the discharge port 132 and sprays the liquid cosmetics in a form of mist by using ultrasonic; a button 160 which is engaged to an upper side of the bucket 130; a front cover 170 and a rear cover 171 which are engaged with each other for thereby accommodating the pump 110, the bucket 130, the ultrasonic vibrator means 140 and the button 160; an ultrasonic driving means 210 which is accommodated in the interior of the front cover 170 and the rear cover 171 and drives the ultrasonic vibrator means 140 in accordance with a switch 201 which operates in accordance with an operation of the button 160; and an electric power part 220 which is accommodated in the front cover 170 and the rear cover 171 and supplies electric power to the ultrasonic driving means 210.

The exhaust port 131 is formed at an inner upper side of the bucket 130.

In addition, the communication part 133 is narrowed toward its lower side to be in consistent with an inner diameter of the discharge port 132.

The ultrasonic vibrator means 140 is formed in such a way that its central portion 141 is outwardly protruded, and a spray hole 142 is formed in a direction which is perpendicular to a curved surface of the central portion 141.

The electric power part 220 is formed of a battery holder 224 accommodated in the front cover 170 and the rear cover 171 and accommodates batteries or one among a charger 221 and a charging circuit 222 and a charging connector 223 connected with the charging circuit which are accommodated in the interior of the front cover 170 and the rear cover 171.

The ultrasonic vibrator means 140 is formed in a such a way that its central portion 141 is outwardly protruded, and a spray hole 142 is formed in a direction which is perpendicular to a curved surface of the central portion 141, and said electric power part 220 is formed of a battery holder accommodated in the front cover 170 and the rear cover 171 and accommodates batteries or one among a charger 221 and a charging circuit 222 and a charging connector 223 connected with the charging circuit which are accommodated in the interior of the front cover 170 and the rear cover 171.

There is further provided an over cap 180 which is detachably engaged to the front cover 170 and the rear cover 171 for covering the front cover 170 and the rear cover 171 and has an elastic sealing part 181 attached to its front upper inner side and shaped in consistent with the shape of the opening 172.

In addition, there are further provided a bucket sealing support member 153 which has a through hole at its center and is installed between the bucket sealing 150 and the ultrasonic vibrator means 140; and a nozzle sealing support member 154 which has a through hole at its center for allowing the nozzle 152 to pass through and is installed at an outer surface of the nozzle sealing part 151.

In addition, the discharge port 132 further comprises a distributor 135 for preventing the generation of foams by uniformly distributing the flow of liquid.

At the upper side of the bucket 130 are provided a pressurizing chamber 138 sealed by means of a bucket 130 and a partition 134 installed at both lower sides of the discharge part 132 of the bucket 130.

In the interior of the bucket 130 is further provided a sterilization ultraviolet ray LED.

Advantageous Effects

The storing container for storing liquid cosmetics according to the present invention is substantially sealed and is designed to discharge liquid cosmetics by a certain amount by suing a pump, so contamination and leakage of liquid cosmetics can be prevented.

With the aid of the construction formed of a communication part 133 in the interior of the bucket, the diameter of which being gradually narrowed toward the lower side in consistent with the inner diameter of the discharge port 132, the liquid cosmetics discharged from the interior of the bucket is all sprayed, not stating therein, so that any contamination due to the residues of the liquid cosmetics and malfunction of the apparatus can be prevented.

The generation of foams and water membrane, which conventionally occur in liquid cosmetics, can be prevented with the aid of the distributor installed in the discharge port, so that smooth and reliable operations can be performed.

The present invention provides an easier carrying performance and an easier exchange or charge of electric power, which can maximize the use and portability of the apparatus.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

Figure 1:
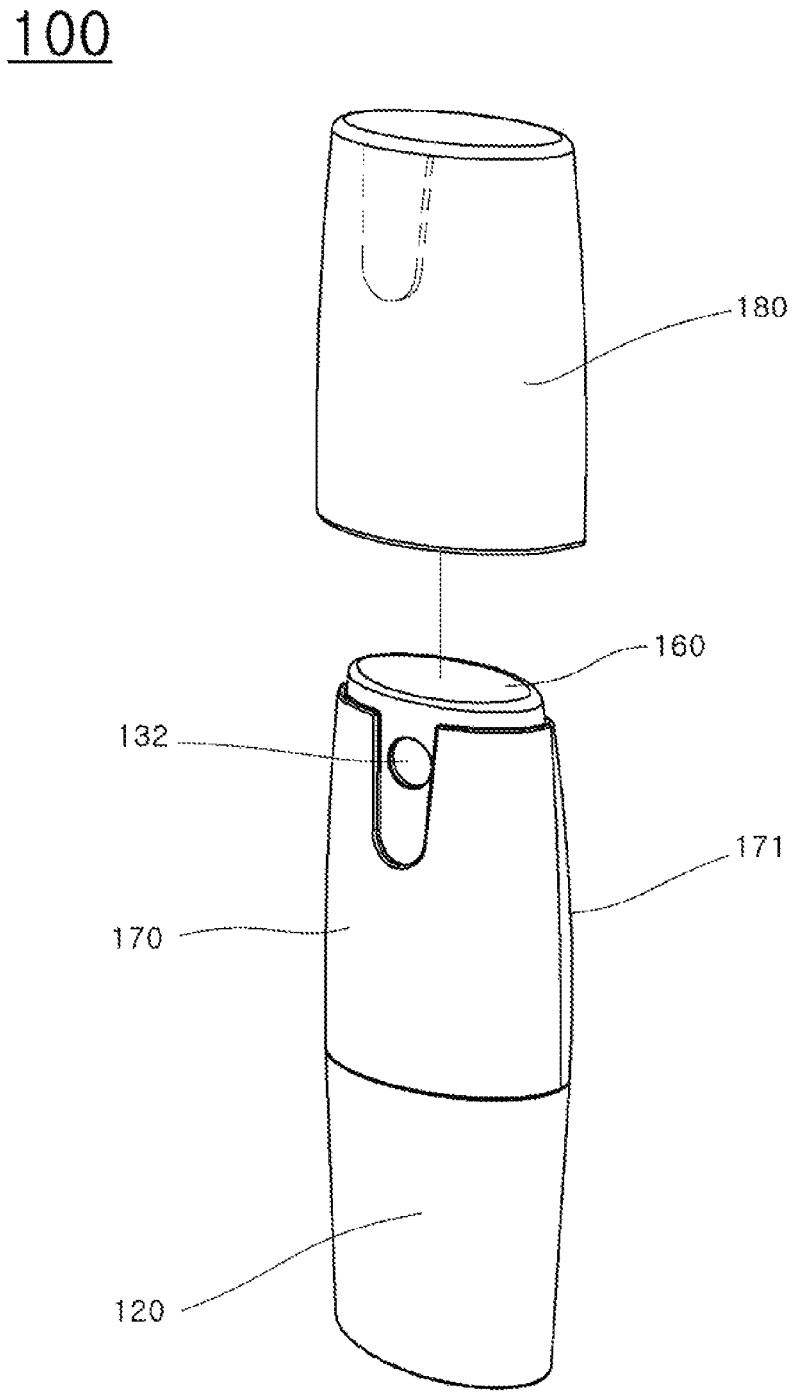
FIG. 1 is a perspective view illustrating an outer appearance construction of a portable electric mist supply apparatus for liquid cosmetics according to a first embodiment of the present invention.

The preferred embodiments of the portable electric mist supply apparatus for liquid cosmetics according to an embodiment of the present invention will be described with reference to the accompanying drawings. It is noted that the same elements or parts are given the same reference numerals. In the descriptions of the present invention, the detailed descriptions on the known functions or constructions will be omitted in order to avoid any confusions in the gist of the present invention.

Figure 2:
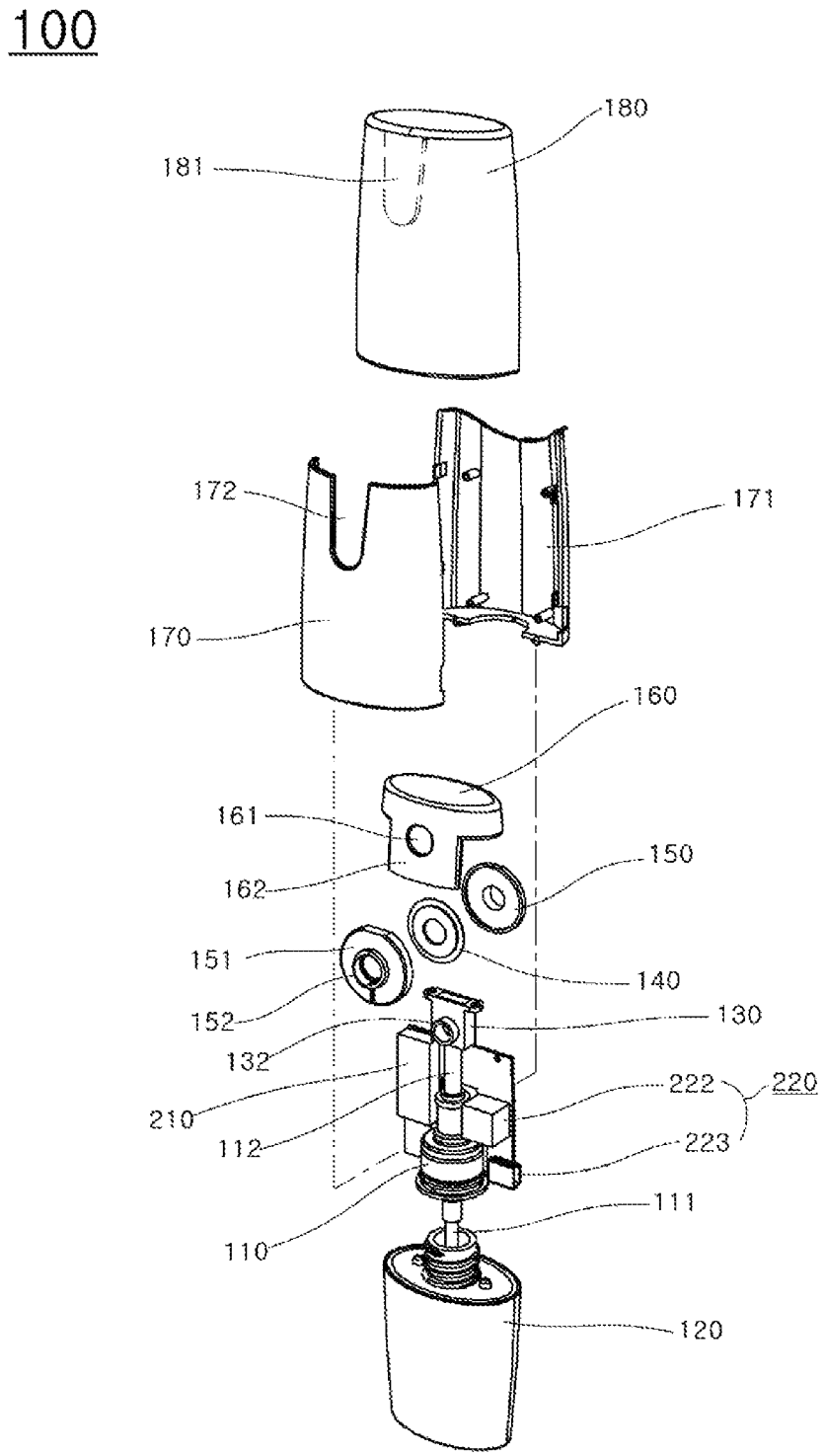
FIG. 2 is a perspective view illustrating a disassembled construction of a portable electric mist supply apparatus for liquid cosmetics according to a first embodiment of the present invention.
Figure 3:
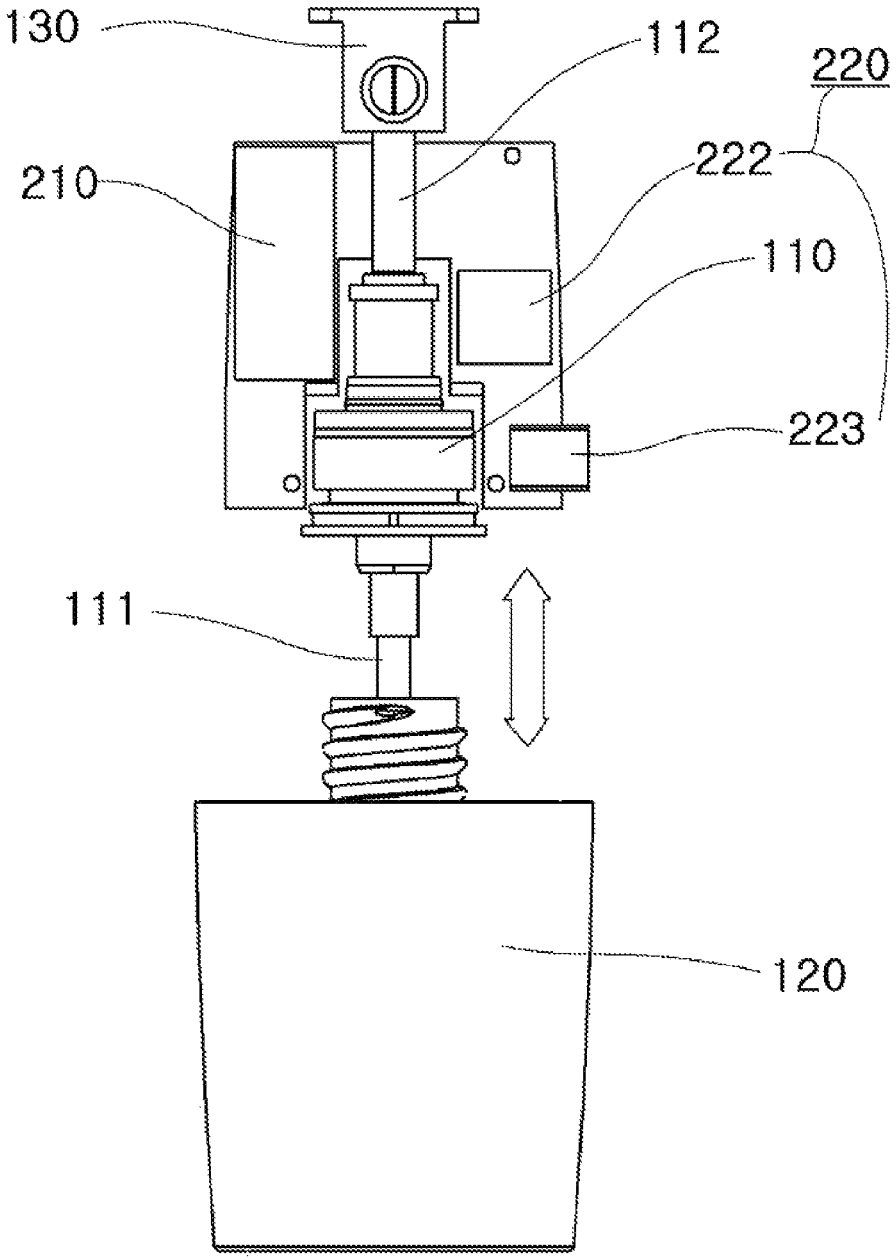
FIG. 3 is a front view illustrating a major part of a portable electric mist supply apparatus for liquid cosmetics according to a first embodiment of the present invention.

As shown in FIG. 2, the portable electric mist supply apparatus 100 for liquid cosmetics according to the present invention comprises a pump 110, a storing container 120, a bucket 130, an ultrasonic vibrator 140, a button 160, a front cover 170 and a rear cover 171, an ultrasonic driving par 210 and an electric power part 220.

Figure 5:
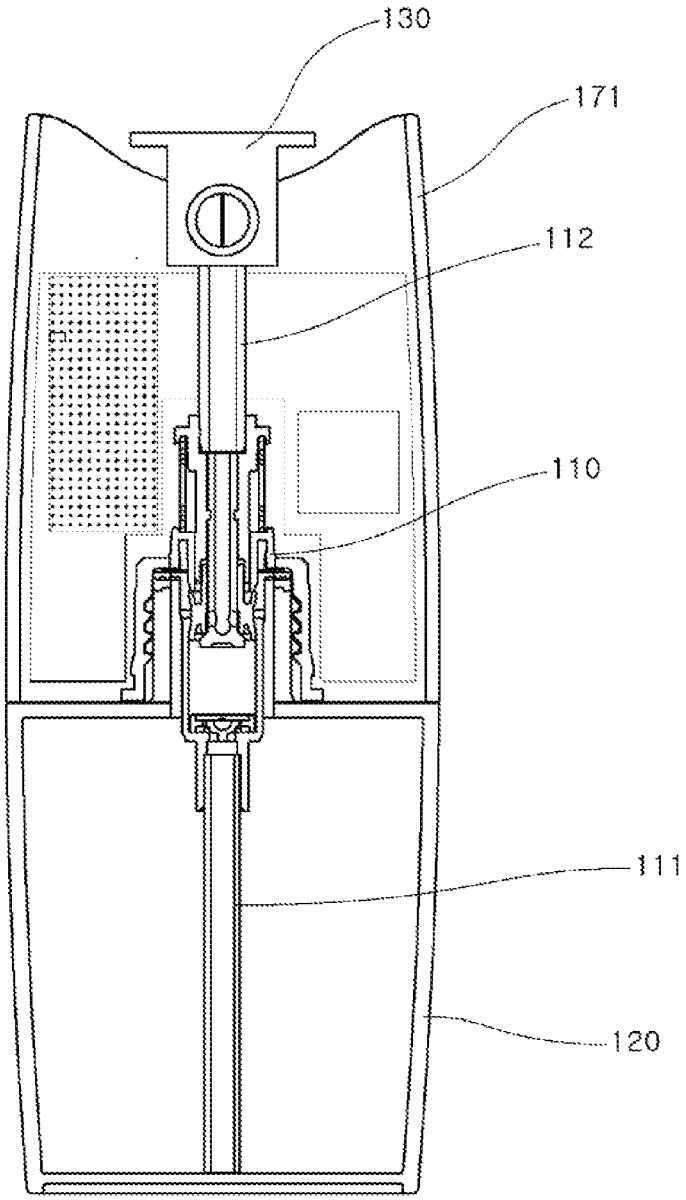
FIG. 5 is a cross sectional view illustrating a major part of a portable electric mist supply apparatus for liquid cosmetics according to a first embodiment of the present invention.

First of all, the pump 110 will be described. As shown in FIG. 5, the pump 110 is formed of a tube 111 disposed at a lower side for sucking liquid cosmetics, and a discharge tube 112 disposed at an upper side and has a function for discharging liquid cosmetics by a certain amount when the discharge tube 112 is pushed. The pump 110 might be formed of various pumps. Since the construction of the pump 110 is known in the art, the detailed descriptions thereon will be omitted.

Figure 13:
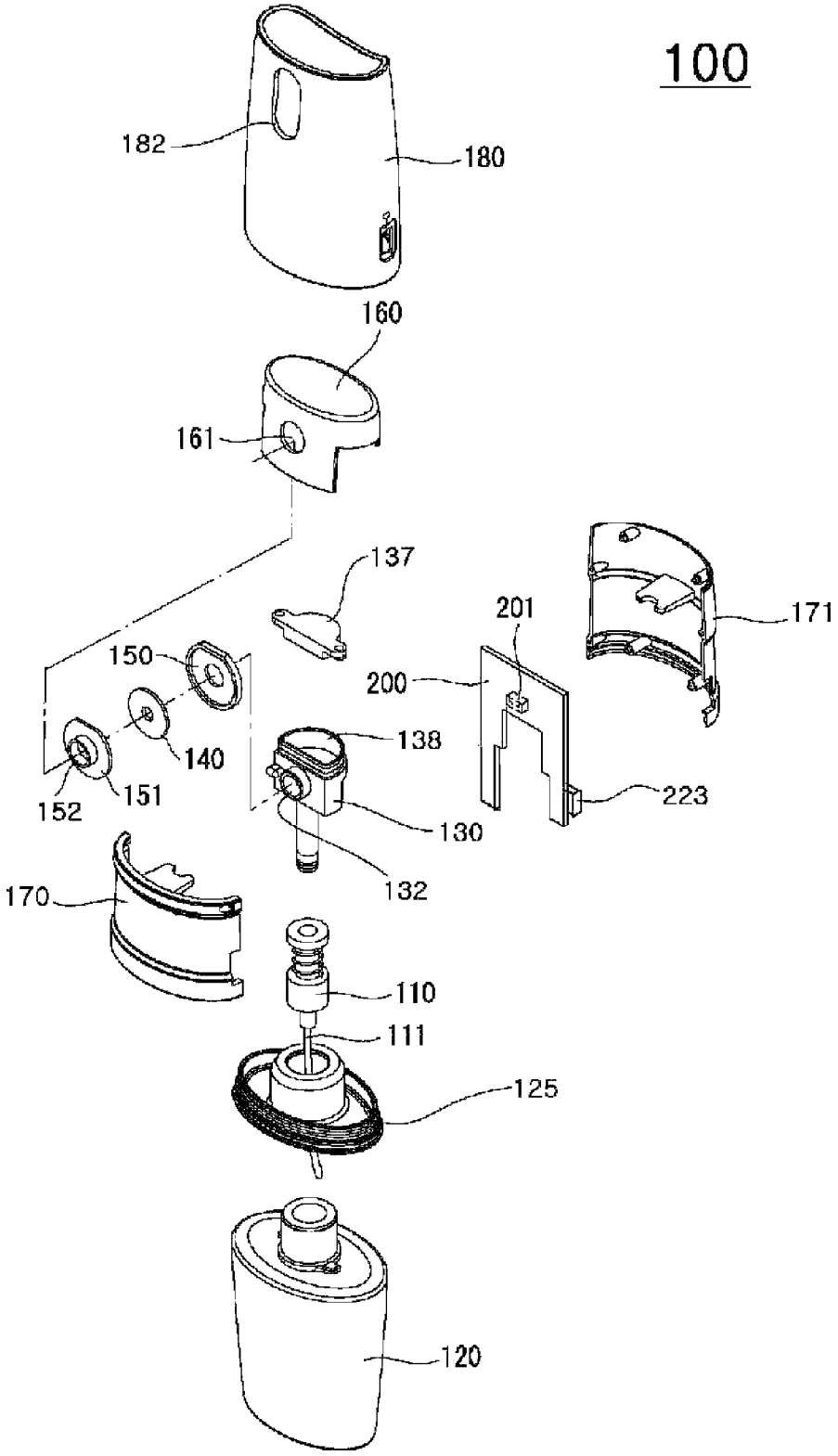
FIG. 13 is a perspective disassembled view illustrating a perspective view illustrating an outer appearance construction of a portable electric mist supply apparatus for liquid cosmetics according to a second embodiment of the present invention.

Next, the storing container 120 will be described. As shown in FIGS. 2 and 5, the storing container 120 is detachably engaged to the pump 110, thus storing liquid cosmetics. The ways of detachably engaging the storing container 120 to the pump 110 are multiple. As one way, it is preferred to use a screw way as shown in FIG. 5. In the present invention, it is possible to substantially prevent any contaminations of liquid cosmetics or leakage of liquid cosmetics with the aid of the construction that the liquid cosmetic is discharged by a certain amount by using a pump 110 when in use. In another example, the pump 110 might be engaged to the storing container 120 in a state that the pump 110 is engaged to an upper cap 125 of the storing container like the second embodiment of the present invention as shown in FIG. 13.

Figure 8:
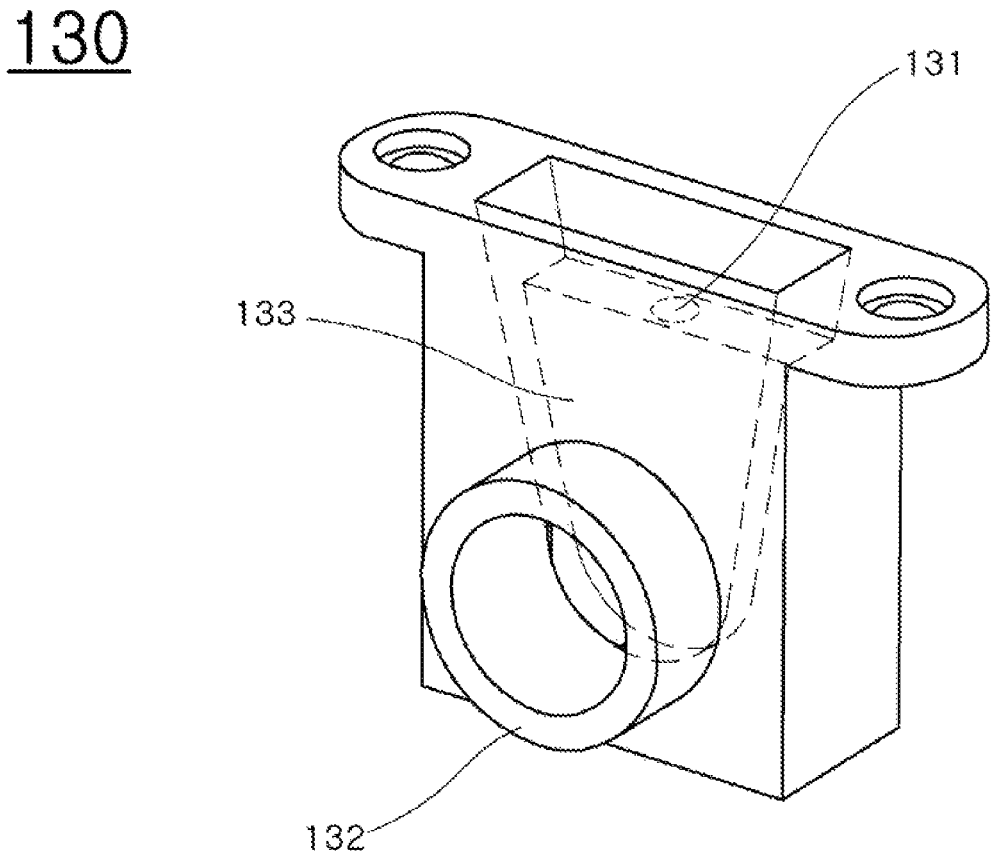
FIG. 8 is a perspective view illustrating a bucket of a portable electric mist supply apparatus for liquid cosmetics according to a first embodiment of the present invention.
Figure 9:
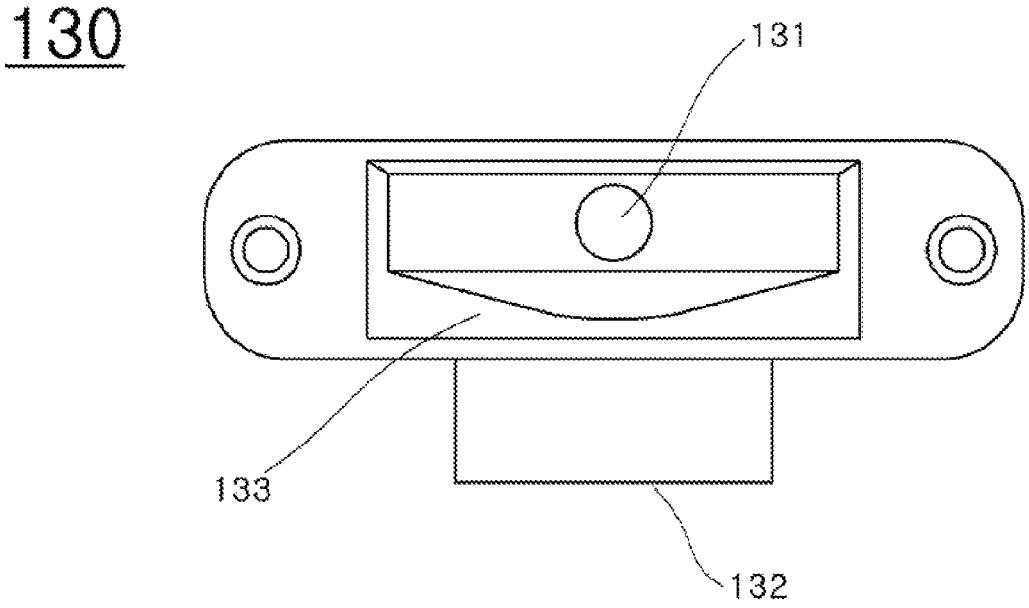
FIG. 9 is a plane view illustrating a bucket of a portable electric mist supply apparatus for liquid cosmetics according to a first embodiment of the present invention.
Figure 10:
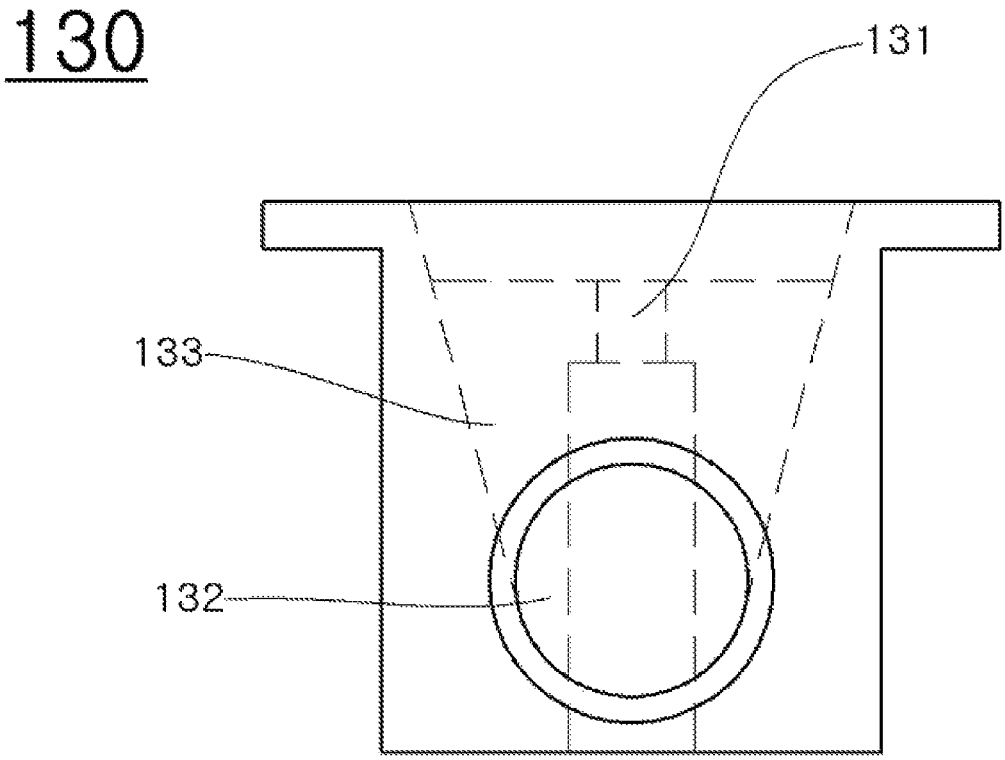
FIG. 10 is a front view illustrating a bucket of a portable electric mist supply apparatus for liquid cosmetics according to a first embodiment of the present invention.

Next, the bucket 130 will be described. As shown in FIGS. 2 and 8, the bucket 130 comprises a discharge port 11 which is formed therein ad engaged to the discharge tube 112, and a communication part 133 which is formed therein and connected with the exhaust port 131 and communicates with the discharge port 132. The bucket 130 serves to store the liquid cosmetics until it is completely discharged and sprayed by the pump 110 via the ultrasonic vibrator 140. As a first embodiment of the present invention, as shown in FIGS. 8 and 10, the bucket 130 comprises the exhaust port 131 formed therein, and the communication part 133 the diameter of which becomes gradually decreased toward the lower side to be inconsistent with the inner diameter of the discharge port 132, so that the liquid cosmetics can be completely sprayed without leaving any residues in the interior of the bucket 130, thus efficiently using the liquid cosmetics. Here, it is preferred to substantially prevent bacteria proliferation and any contamination due to internal residue.

Figure 12:
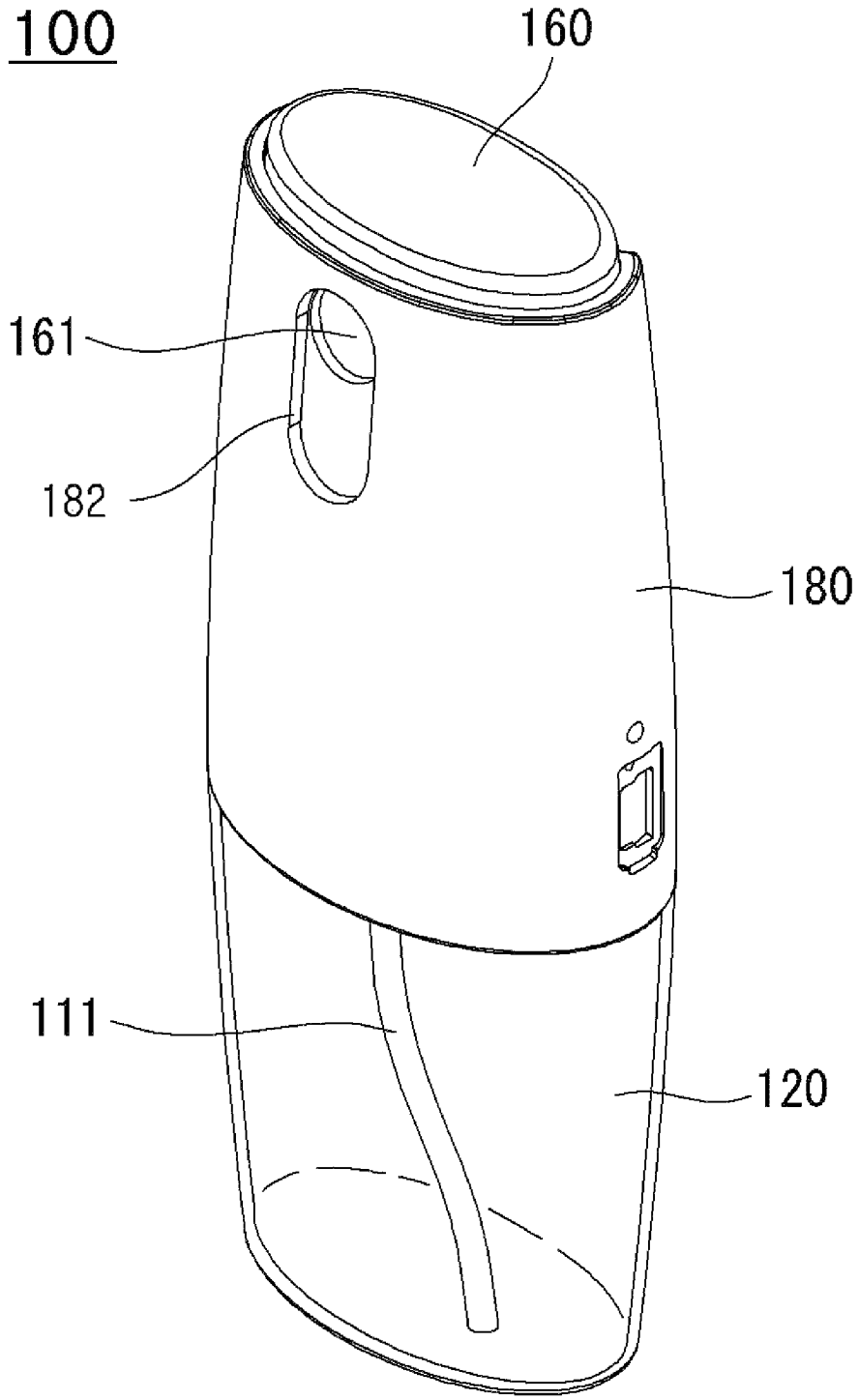
FIG. 12 is a perspective view illustrating an outer appearance construction of a portable electric mist supply apparatus for liquid cosmetics according to a second embodiment of the present invention.
Figure 15:
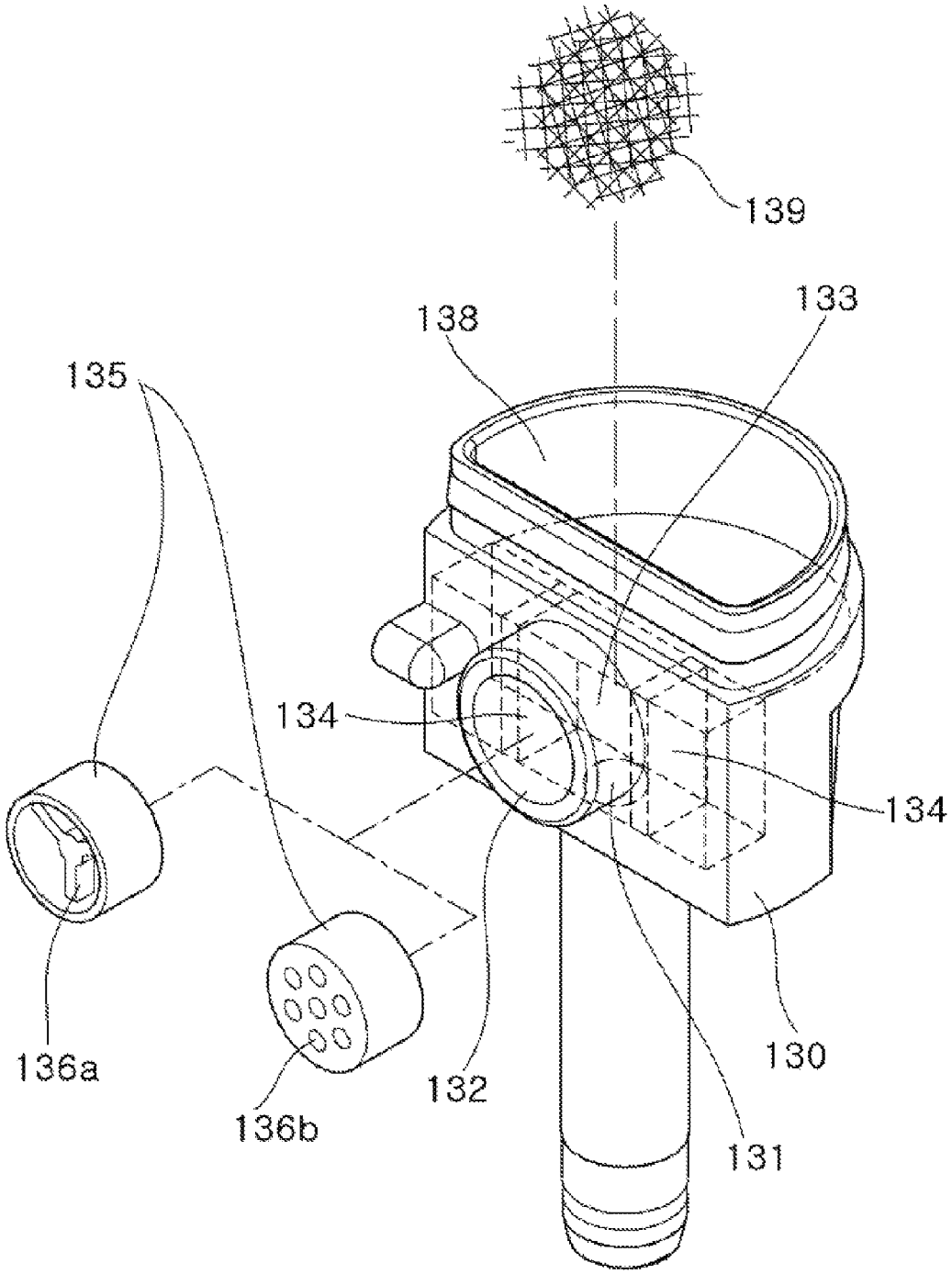
FIG. 15 is a view illustrating an engaged construction of a bucket and a distributor of a portable electric mist supply apparatus for liquid cosmetics according to a second embodiment of the present invention.

According to a second embodiment of the present invention, as shown in FIGS. 12 and 15, a pressurizing chamber 138 might be further disposed on the upper side of the bucket 130 and is sealed by a bucket cover 137. The internal volume of the bucket 130 increases by the pressurizing chamber 138. The pressurizing chamber 138 is designed to apply pressure to the liquid cosmetics during the spraying period and obtain an efficient spraying operation as the internal air as much as the volume of the liquid cosmetics discharged in the interior of the bucket 130 is compressed.

Figure 14:
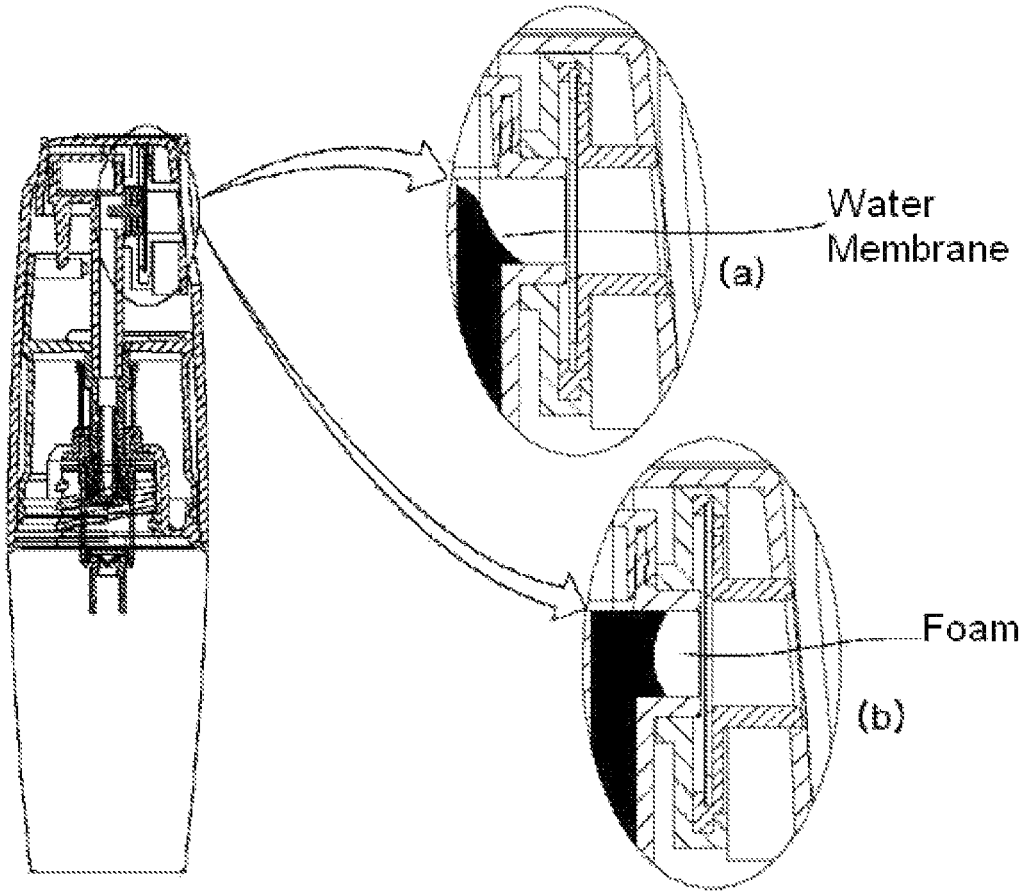
FIG. 14 is a perspective view of a water membrane and foam generation state of a portable electric mist supply apparatus for liquid cosmetics according to a second embodiment of the present invention.

In case of the liquid cosmetics used in the present invention, since its phase is liquid state, the water membrane might be formed by surface tension as shown in FIG. 14A or foams might be formed as shown in FIG. 14B. In order to prevent such problems, as shown in FIG. 15, a partition 134 is further installed at both lower sides of the discharge port 130 in the interior of the bucket 130. With the above construction, when the same volume liquid cosmetics are discharged into the interior of the bucket 13 and are stored therein, water membrane and foam generations are prevented by maintaining higher water level, thus obtaining more efficient operations. It is preferred to install the distributor 135 at the discharge port 132 as shown in FIG. 15 in order to divide water membrane or foams into multiple parts and prevent them from forming, which water membrane and foams are generally generated in liquid cosmetics. The distributor 135 might be implemented in various forms. As an example of the present invention, as shown in FIG. 15, a through hole might be formed at the center of the distributor, and at least three distribution supports 136*a* might be formed for dividing and distributing the flow of liquid in the direction from the center to the peripheral side. In addition, as another example of the distributor 135, as shown in FIG. 15, a plurality of through holes 136*b* might be formed. As shown in FIG. 15, the functions similar with the distributor 135 might be obtained simply filling porous members 39 into the communication part 133 of the interior of the bucket 130. When the porous member 139 is used together with the distributor 135, more effective water membrane and foam prevention effects can be obtained.

Figure 18:
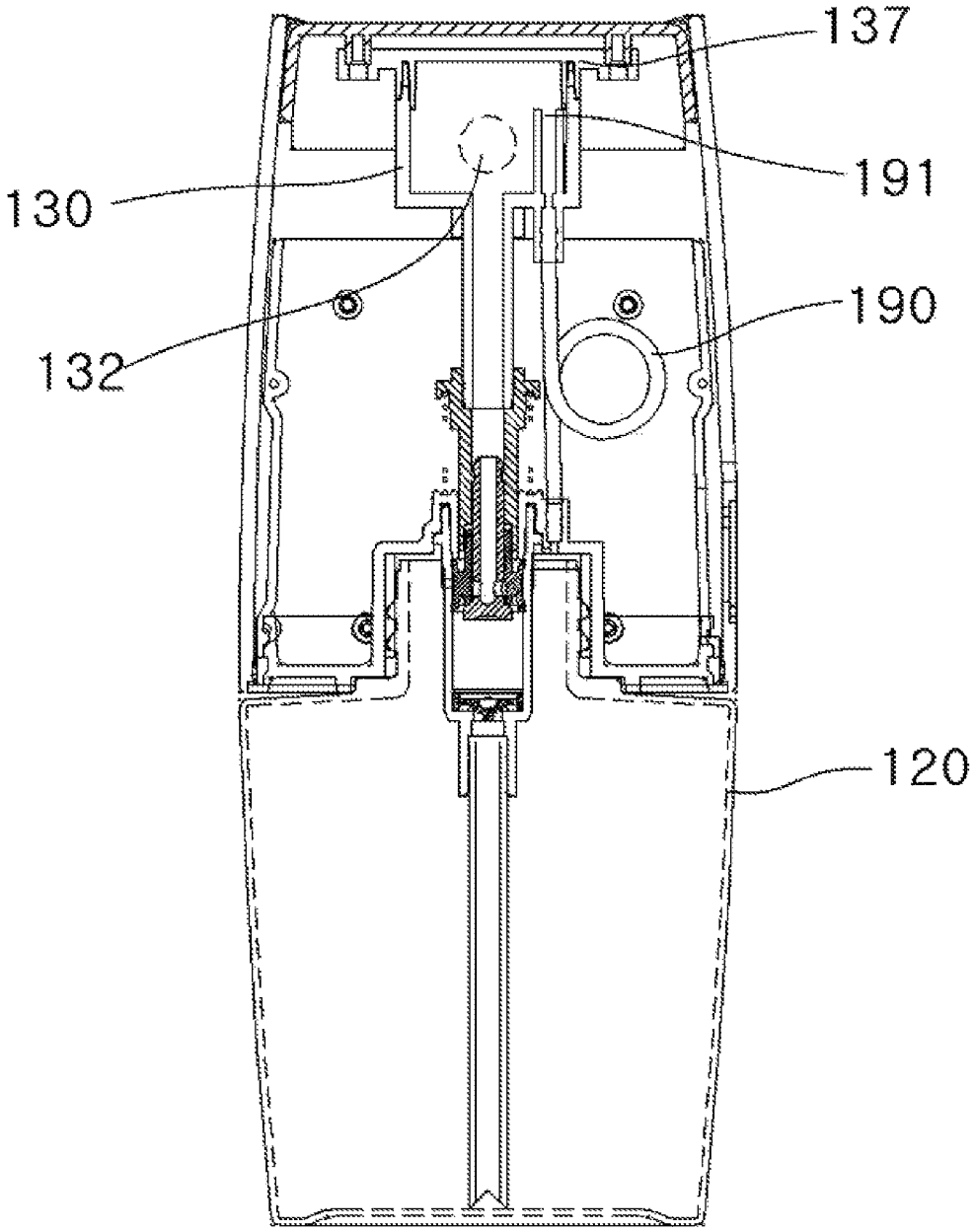
FIG. 18 is a cross sectional view illustrating a leakage tube of a portable electric mist supply apparatus for liquid cosmetics according to a second embodiment of the present invention.

As show in FIG. 18, a leakage tube 190 might be further provided at the inner side of the bucket 130 in an attempt to return the leakage of surplus liquid cosmetics, which might occur depending on operation environment, to the storing container 120 by connecting a drain hole 191 formed at the upper side of the discharge port 132 with the storing container 120.

Next, the ultrasonic vibrator 140 will be described. As shown in

Figure 11:
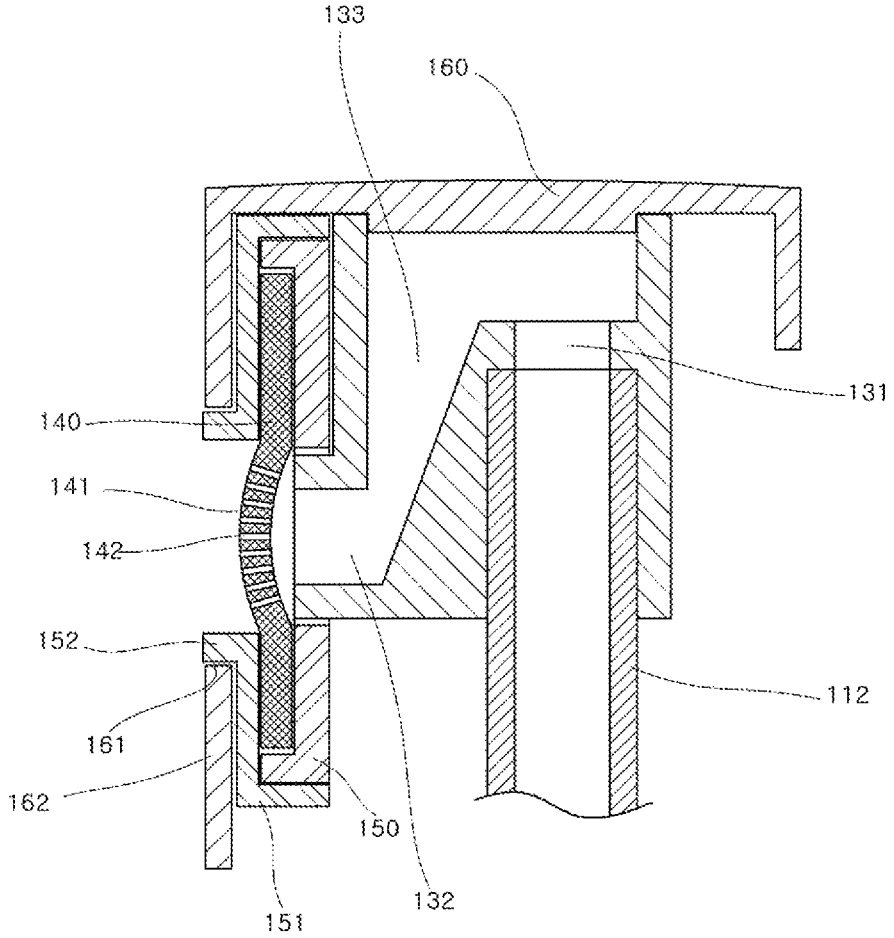
FIG. 11 is a cross sectional perspective view illustrating a bucket of a portable electric mist supply apparatus for liquid cosmetics according to a first embodiment of the present invention.
Figure 16:
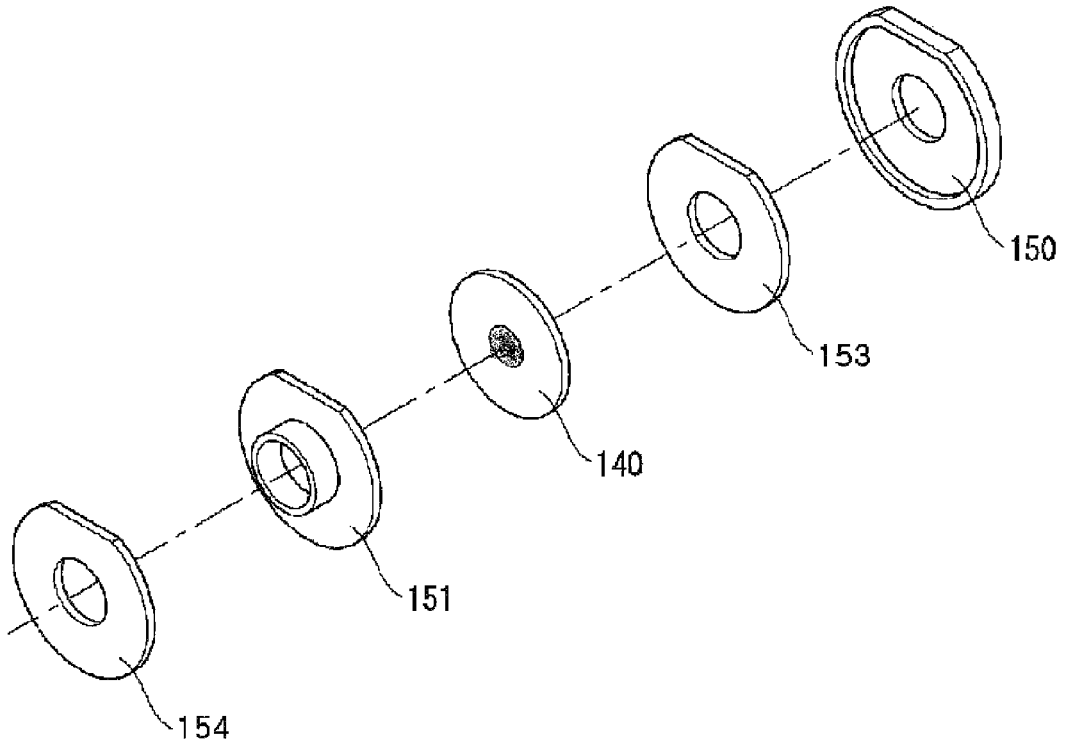
FIG. 16 is a disassembled perspective view illustrating a sealing part of a portable electric mist supply apparatus for liquid cosmetics according to a second embodiment of the present invention.
Figure 17:
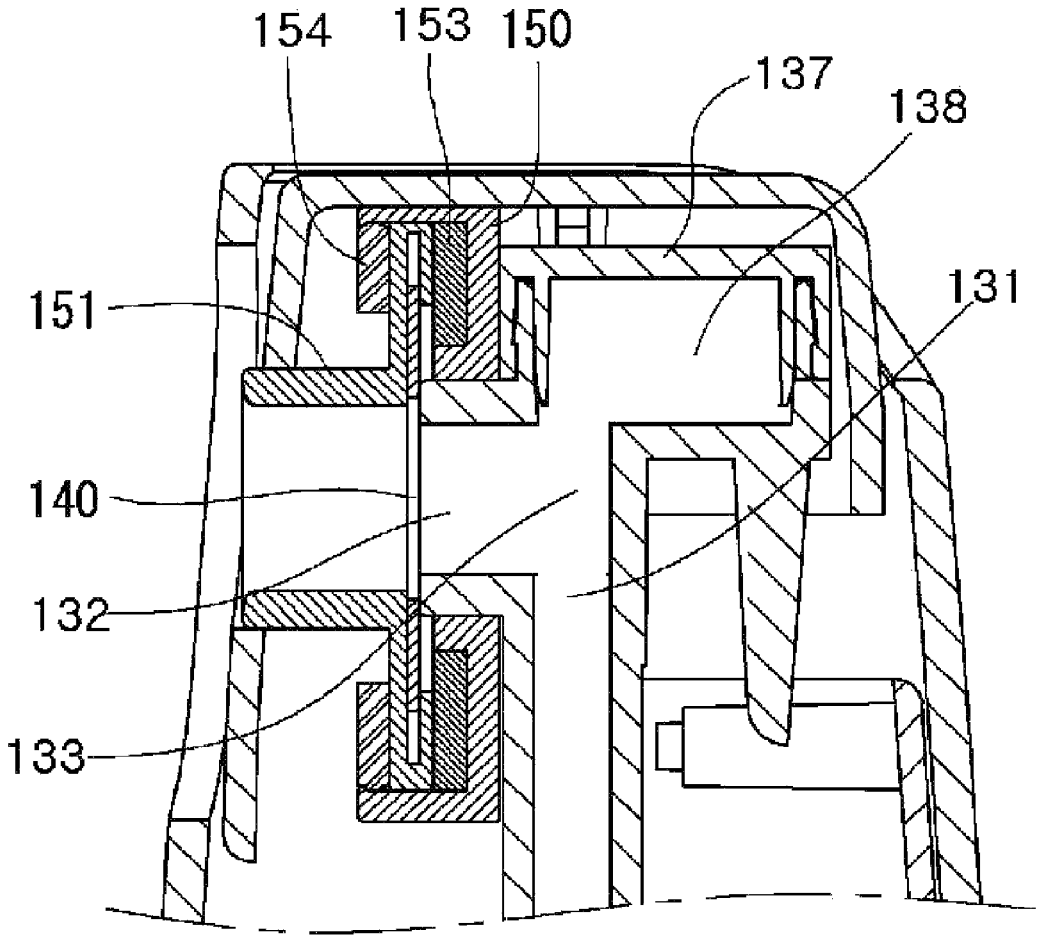
FIG. 17 is a cross sectional view illustrating a sealing part of a portable electric mist supply apparatus for liquid cosmetics according to a second embodiment of the present invention.

FIGS. 2 and 11, the ultrasonic vibrator 140 is engaged to the discharge port 132 and serves to spray liquid cosmetics in a form of mist by using ultrasonic. In this case, it is preferred that the ultrasonic vibrator 140 has an outwardly protruded central portion 141 as shown in FIG. 11 in order to more effectively spray liquid cosmetics at wider angles, and it is further preferred that a plurality of spray holes 142 are formed in the right angle direction with respect to the curved surface of the central potion 141. As shown in FIGS. 2 and 11, the ultrasonic vibrator 140 is preferably installed between a bucket sealing 150 with a through hole at its center and a nozzle sealing 151 with a nozzle 152 at an outer side in order to prevent leakage occurring in an outward direction during operation. The above construction of the ultrasonic vibrator 140 is widely known to a person with ordinary skills in the art, so the descriptions thereon will be omitted. The bucket sealing 150 and the nozzle sealing 151 are preferably made of an elastic material such as silicon to prevent leakage. In this case, the bucket sealing 150 and the nozzle sealing 151 might be deformed during the installation or when in use by means of elastic force. In this case, leakage might occur or some deviations might occur in discharge amount and discharge angle. As shown in FIGS. 16 and 17, in order to prevent such deformation, there are provide a bucket sealing support member 153 between the bucket sealing 150 and the ultrasonic vibrator 140, and a nozzle sealing support member 154 installed at an outer surface of the nozzle sealing 151.

Figure 4:
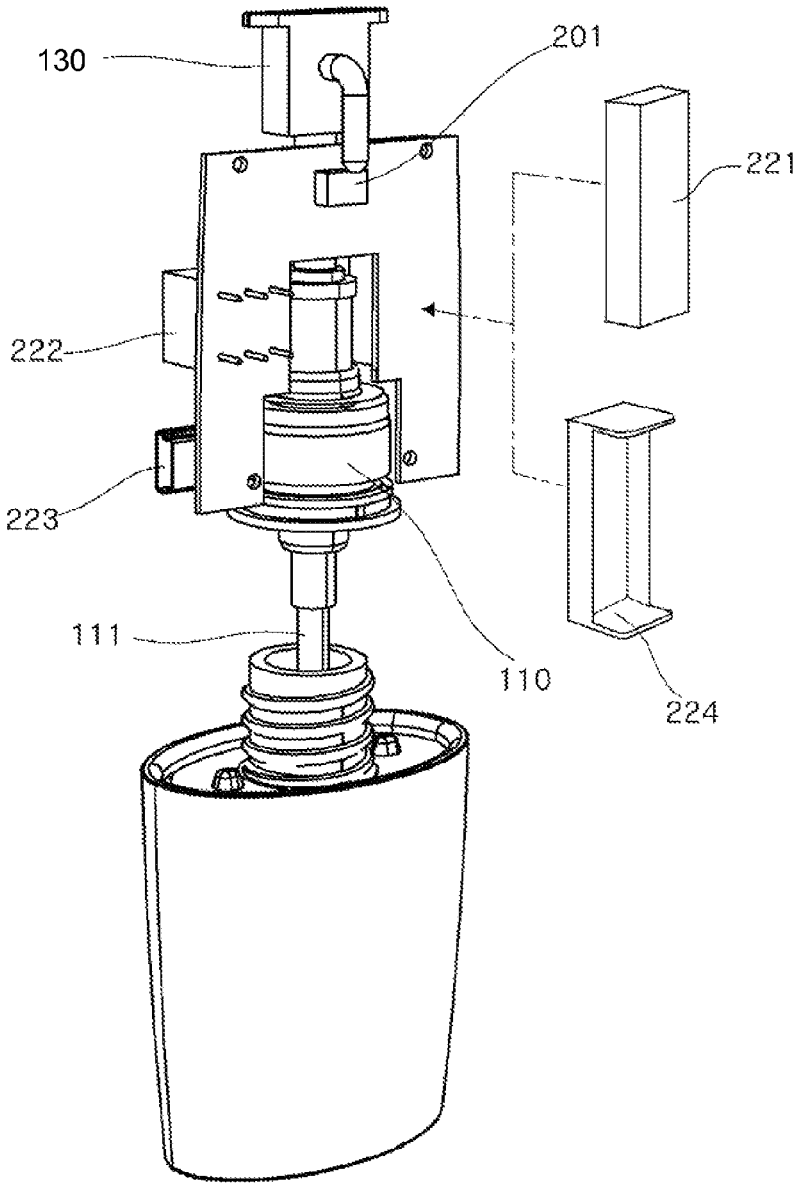
FIG. 4 is a perspective rear side view illustrating a major part of a portable electric mist supply apparatus for liquid cosmetics according to a first embodiment of the present invention.
Figure 6:
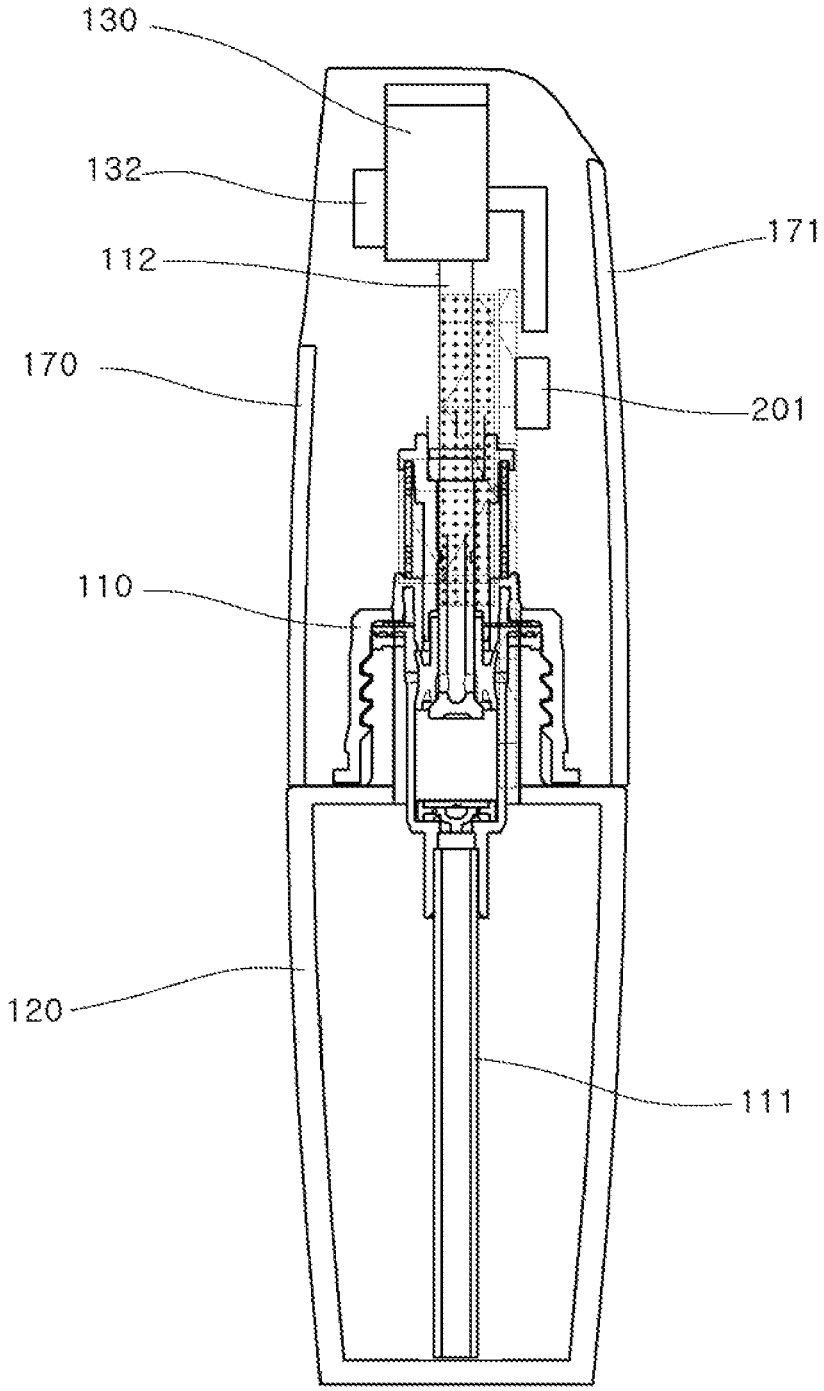
FIG. 6 is a cross sectional side view illustrating a major part of a portable electric mist supply apparatus for liquid cosmetics according to a first embodiment of the present invention.
Figure 7:
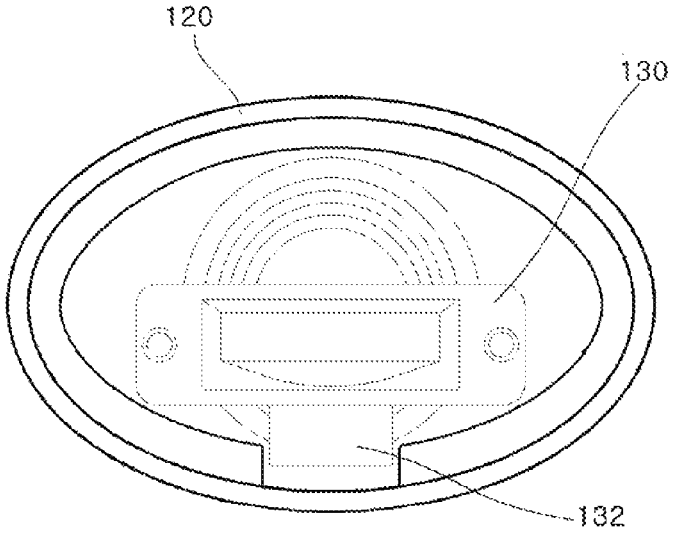
FIG. 7 is a plane view illustrating a major part of a portable electric mist supply apparatus for liquid cosmetics according to a first embodiment of the present invention.

The button 160 will be described. As shown in FIGS. 2 and 11, the button 60 is engaged to an upper side of the bucket 130. When a user pushes the button 160, a certain amount of the liquid cosmetics is discharged via the bucket 130 by means of the pump 110 as the discharge tube 112 is pushed. As shown in FIGS. 4 and 6, as the button 160 is pressed, the switch 201 starts working, and the ultrasonic driving part 210 drives the ultrasonic vibrator 140.

The front cover 170 and the rear cover 171 will be described. As shown in FIGS. 1 and 2, the front cover 170 and the rear cover 171 are engaged with each other to accommodate therein the pump 110, the bucket 130, the ultrasonic vibrator 140 and the button 160. In the inner space between the front cover 170 and the rear cover 171 are accommodated the ultrasonic driving part 210 and the electric power part 220. The ultrasonic driving part 210 drives the ultrasonic vibrator 140 depending on the operation of the switch 201. In this case, the ultrasonic driving part 210 serves to transfer the electric power of the electric power 220 to the ultrasonic vibrator 140 depending on the operation of the switch 201 so that the ultrasonic vibrator 140 keeps operating until the button 160 is being pushed by the user. In addition, when the user pushes one time the button 160, the ultrasonic driving part 210 might be designed to operate for a while so that the liquid cosmetics can be completely discharged and sprayed from the interior of the bucket 30 after the operation of the switch 201 is finished as the button 160 returns to its original position. In addition, the ultrasonic driving part 210 might be designed to allow the ultrasonic vibrator 140 to operate for a while until the liquid cosmetics are completely discharged from the interior of the bucket 130 by detecting the residues of the liquid cosmetics in the interior of the bucket 130 by means of a liquid detection sensor 224 in the interior of the bucket 130. The construction of the ultrasonic driving part 210 is known to a person with ordinary skills in the art, so the descriptions thereon will be omitted.

The electric power part 220 will be described. The electric power pat 220 serves to supply electric power needed to drive the ultrasonic driving part 210. The electric power part 220 might be formed in various forms. For a better portability of the portable electric mist supply apparatus 100 for liquid cosmetics according to the present invention, the electric power part 220 is accommodated in the interior of the front cover 170 and the rear cover 171 and might be formed of either a battery holder for accommodating batteries or one among a charger 221, a charging circuit 222 and a charging connector 223 which are accommodated in the interior of the front cover 170 and the rear cover 171. In this case, it is preferred that the charging connector 223 is formed of a USB connector, and the charging circuit 222 is formed to operate with a USB power.

When the ultrasonic vibrator 140 is installed between the bucket sealing 150 and the nozzle sealing 151, as shown in FIG. 2 and 11 or 13, at the front extension part 162 of the button 160 is formed a nozzle engaging hole 161 to which the nozzle 152 is engaged. At this time, in case of the outer appearance of the first embodiment of the present invention, it is preferred that at the front upper side of the front cover 170 is formed an opening 172 so that the nozzle 152 can expose to the outside when the button 160 moves up and down.

In case of the outer appearance of the first embodiment of the present invention, as shown in FIG. 2, it is preferred that there is further provided an over cap 180 to a front upper inner side of which an elastic sealing part 181 is attached, which part 181 is in consistent with the shape of the opening 172 so that the opening 172 can be completely sealed. The over cap 180 is detachably engaged to the front cover 170 and the rear cover 171, respectively. In case of an outer appearance of a second embodiment of the present invention, as shown in FIGS. 12 and 13, an over cap 180 with an open hole 182 allowing the nozzle part 152, which is formed at a front surface, to be exposed to the outside is detachably attached to the front cover 170 and the rear cover 171.

It is preferred that a sterilization ultraviolet ray LED (not shown) is installed in the interior of the bucket 130, thus preventing proliferation of bacteria, etc.

The operation of the portable electric mist supply apparatus 100 for liquid cosmetics according to the present invention will be described.

When a user pushes the button 160 in order to use the portable electric mist supply apparatus for liquid cosmetics according to the present invention, the downward movement of the button 160 helps push the discharge tube 112 via the bucket 130, and a certain amount of the liquid cosmetics is discharged by means of the pump 110, and a certain amount of the liquid cosmetic is stored in the interior of the bucket 130.

At the same time, the switch 201 operates by means of an operation of the button 160, and the ultrasonic vibrator 140 is operated by means of the ultrasonic driving part 210, so the liquid cosmetics stored in the bucket 130 can be spayed in a form of mist particles.

In case of the first embodiment of the present invention, there is a communication part 133 which communicates the exhaust port 131 and the discharge port 132 and is narrowed toward the lower side to be in consistent with the inner diameter of the discharge port 132, so the residues of the liquid cosmetics can be completely discharged to the outside from the interior of the bucket 130 and can be sprayed. So, more efficient use of liquid cosmetics is possible, and bacteria proliferation and contamination due to internal residues can be prevented.

Foams or water membranes occurring in the liquid cosmetics stored in the bucket 130 can be prevented from generating by means of the distributor 135 or the partition, so it is possible to perform a stable spraying operation unless a user swings the apparatus of the present invention to overcome operation failures due to foams or water membrane.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A portable electric mist supply apparatus for liquid cosmetics, comprising:

a pump which is formed of a tube disposed at its lower side for sucking liquid cosmetics and a discharge tube disposed at its upper side and serves to discharge a certain amount of liquid cosmetics when the discharge tube is pushed;

a storing container which is detachably engaged to the pump and stores the liquid cosmetics;

a bucket which includes an exhaust port which is engaged to the discharge tube and is formed in its interior and is connected with the discharge tube, a discharge port which is formed at a front lower side and discharges the liquid cosmetics, and a communication part which is formed in the interior and communicates the exhaust part and the discharge port;

an ultrasonic vibration means which is engaged to the discharge port and sprays the liquid cosmetics in a form of mist;

a button which is engaged to an upper side of the bucket;

a front cover and a rear cover which are engaged with each other for thereby accommodating the pump, the bucket, the ultrasonic vibration means and the button;

an ultrasonic driving means which is accommodated in the interior of the front cover and the rear cover and drives the ultrasonic vibration means in accordance with a switch which operates in accordance with an operation of the button; and an electric power part which is accommodated in the front cover and the rear cover and supplies electric power to the ultrasonic driving means.

2. The apparatus of claim 1, wherein said exhaust port is formed in an upper surface of the bucket.

3. The apparatus of claim 2, wherein said communication part is narrowed toward its lower side to be in consistent with an inner diameter of the discharge port.

4. The apparatus of claim 3, wherein said ultrasonic vibration means is formed in such a way that its central portion is outwardly protruded, and a spray hole is formed in a direction which is perpendicular to a curved surface of the central portion.

5. The apparatus of claim 3, wherein said electric power part is formed of a battery holder accommodated in the front cover and the rear cover and accommodates batteries or one among a charger and a charging circuit and a charging connector connected with the charging circuit which are accommodated in the interior of the front cover and the rear cover.

6. The apparatus of claim 3, wherein said ultrasonic vibration means is formed in such a way that its central portion is outwardly protruded, and a spray hole is formed in a direction which is perpendicular to a curved surface of the central portion, and said electric power part is formed of a battery holder accommodated in the front cover and the rear cover and accommodates batteries or one among a charger and a charging circuit and a charging connector connected with the charging circuit which are accommodated in the interior of the front cover and the rear cover.

7. The apparatus of one among claims 2 to 6, wherein said ultrasonic vibration means is installed between a bucket seal having a through hole at its center for preventing leakage to the outside during operation and a nozzle seal having a through hole at its center and a nozzle at its outer side, and at a front extension part of the button is formed a nozzle engaging hole to which the nozzle is engaged, and at a front upper side of the front cover is formed an opening for thereby exposing the nozzle to the outside when the button moves up and down.

8. The apparatus of claim 7, further comprising:

a distributor which is installed at the discharge port and distributes the flow of liquid, thus preventing the generation of foams or water membrane;

a bucket sealing support member which has a through hole at its center and is installed between the bucket seal and the ultrasonic vibration means; and a nozzle sealing support member which has a though hole formed at its center for allowing the nozzle to pass through and is installed at an outer side of the nozzle seal.

9. The apparatus of claim 8, further comprising:

an over cap which is detachably engaged to the front cover and the rear cover for covering the front cover and the rear cover and has an elastic sealing part attached to its front upper inner side and shaped in consistent with the shape of the opening.

10. The apparatus of claim 1, further comprising:

a pressurizing chamber which is disposed at an upper side of the bucket and is sealed by a bucket cover; and a partition which is installed at opposing sides of the discharge port in the interior of the bucket.

11. The apparatus of claim 10, wherein at said discharge port is installed a distributor which distributes the flow of liquid and prevents the generation of foams.

12. The apparatus of claim 11, wherein said ultrasonic vibration means is installed between a bucket seal having a through hole at its center for preventing leakage to the outside during operation and a nozzle seal having a through hole at its center and a nozzle at its outer side, and at a front extension part of the button is formed a nozzle engaging hole to which the nozzle is engaged.

13. The apparatus of claim 12, further comprising:

a bucket sealing support member which has a through hole at its center and is installed between the bucket seal and the ultrasonic vibration means; and a nozzle sealing support member which has a through hole at its center for allowing the nozzle to pass through and is installed at an outer surface of the nozzle seal.

14. The apparatus of one among claims 10 to 13, wherein said ultrasonic vibration means is formed in a such a way that its central portion is outwardly protruded, and a spray hole is formed in a direction which is perpendicular to a curved surface of the central portion, and said electric power part is formed of a battery holder accommodated in the front cover and the rear cover and accommodates batteries or one among a charger and a charging circuit and a charging connector connected with the charging circuit which are accommodated in the interior of the front cover and the rear cover.

15. The apparatus of claim 14, further comprising:

an over cap which is detachably engaged to the front cover and the rear cover for covering the front cover and the rear cover and has an elastic sealing part attached to its front upper inner side and shaped consistent with a shape of an opening of the front cover.

16. The apparatus of claim 15, wherein said communication part is filled with a porous member.

17. The apparatus of claim 14, further comprising a leakage tube which connects a drain hole positioned at an upper side of the discharge port inside the bucket to the container, thus returning the leakage of surplus liquid cosmetics to the storing container.

* * * * *